US007758326B2

(12) United States Patent
Fujimura et al.

(10) Patent No.: US 7,758,326 B2
(45) Date of Patent: Jul. 20, 2010

(54) SCROLL FLUID MACHINE

(75) Inventors: Kazuyuki Fujimura, Hitachinaka (JP); Takeshi Tsuchiya, Tsuchiura (JP); Yuichi Yanagase, Namegata (JP); Makoto Aoki, Kasama (JP); Masashi Miyake, Shizuoka (JP); Mutsunori Matsunaga, Shizuoka (JP); Satoshi Nakamura, Shizuoka (JP); Masaru Ohtahara, Shizuoka (JP); Syuuji Hasegawa, Shizuoka (JP); Hiroyuki Imamura, Shizuoka (JP); Yoshinobu Yosuke, Shizuoka (JP); Kenji Tojo, Moriya (JP)

(73) Assignee: Hitachi Appliances, Inc., Tokyo (JP)

( * ) Notice: Subject to any disclaimer, the term of this patent is extended or adjusted under 35 U.S.C. 154(b) by 316 days.

(21) Appl. No.: 11/698,865

(22) Filed: Jan. 29, 2007

(65) Prior Publication Data

US 2007/0231172 A1 Oct. 4, 2007

(30) Foreign Application Priority Data

Mar. 31, 2006 (JP) ..... 2006-096359

(51) Int. Cl.
*F01C 1/02* (2006.01)

(52) U.S. Cl. ..... 418/55.5; 418/55.1

(58) Field of Classification Search ..... 418/55.1–55.6
See application file for complete search history.

(56) References Cited

U.S. PATENT DOCUMENTS 4,596,521 A * 6/1986 Murayama et al. ..... 418/55.1
4,818,195 A * 4/1989 Murayama et al. ..... 418/15
4,854,831 A * 8/1989 Etemad et al. ..... 417/366
5,037,278 A * 8/1991 Fujio et al. ..... 418/55.2
5,040,956 A * 8/1991 Barito et al. ..... 418/1
5,256,044 A * 10/1993 Nieter et al. ..... 418/55.5
5,263,822 A * 11/1993 Fujio ..... 418/55.4
5,494,422 A * 2/1996 Ukai et al. ..... 418/55.1

(Continued)

FOREIGN PATENT DOCUMENTS

JP 59-180094 10/1984

(Continued)

OTHER PUBLICATIONS

Chinese Office Action issued in Chinese Patent Application No. 200710008268X on Jun. 27, 2008.

*Primary Examiner*—Thomas Denion
*Assistant Examiner*—Douglas J. Duff
(74) *Attorney, Agent, or Firm*—Antonelli, Terry, Stout & Kraus, LLP.

(57) ABSTRACT

A scroll fluid machine comprises compression chambers defined with an orbiting scroll orbiting relative to a fixed scroll, and a back pressure chamber provided on the face opposite from a wrap of the orbiting scroll. A back pressure port is provided, which is formed in an end-plate of the orbiting scroll and connects from a compression chamber side opening opened to a compression chamber side and to a back pressure chamber side opening opened to a back pressure chamber side. The compression chamber side opening is opened and closed by an end-plate of the fixed scroll according as the orbiting motion of the orbiting scroll to perform connection and blockage of the back pressure port. The flow resistance of fluid flowing in and out between the back pressure chamber and the compression chamber is reduced and the compression efficiency and reliability are improved.

7 Claims, 5 Drawing Sheets

U.S. PATENT DOCUMENTS 5,520,526 A * 5/1996 Fujio ..... 418/55.4
5,660,539 A * 8/1997 Matsunaga et al. ..... 418/55.6
5,855,475 A * 1/1999 Fujio et al. ..... 418/15
6,027,321 A * 2/2000 Shim et al. ..... 418/1
6,056,523 A * 5/2000 Won et al. ..... 418/15
6,174,150 B1 * 1/2001 Tsubono et al. ..... 418/55.5
6,428,295 B1 * 8/2002 Kobayashi et al. ..... 418/55.5
6,527,528 B1 * 3/2003 Barito et al. ..... 418/55.5
6,872,063 B2 * 3/2005 Kimura et al. ..... 418/55.5
7,018,185 B2 * 3/2006 Makino et al. ..... 418/94
7,163,386 B2 * 1/2007 Tsuchiya et al. ..... 418/55.5

FOREIGN PATENT DOCUMENTS

JP 02-130284 5/1990
JP 2-150669 6/1990

* cited by examiner

SCROLL FLUID MACHINE

BACKGROUND OF THE INVENTION

The present invention relates to a scroll fluid machine such as a scroll compressor, a scroll expander, a scroll vacuum pump, a scroll blower, etc. for handling compressive gas or liquid such as refrigerants, and more particularly to a scroll fluid machine suited for maintaining hermetic sealing in the axial direction by applying fluid pressure on the back side of an orbiting scroll.

Hitherto, it is known that, in a scroll fluid machine provided with back a pressure port (back pressure passage) from a compression chamber to the back pressure chamber of an orbiting scroll for keeping the hermetic sealing in the axial direction by pressing the orbiting scroll against a fixed scroll, a back pressure chamber side opening is opened only when the pressure of the compression chamber becomes approximately equal to that of the back pressure chamber in order to reduce power loss accompanying the flowing of fluid in and out of the back pressure port in a wide range of rotation speed. Such a technique is disclosed in, for instance, JP-A-H02-130284.

SUMMARY OF THE INVENTION

In the conventional art described above, as the back pressure chamber side opening is opened and closed by the sliding face of the fixed scroll to open the back pressure port formed in the end-plate of the orbiting scroll, the back pressure passage requires a plurality of bends in it, resulting in a complex shape and a long length, which may increase the flow resistance of the back pressure passage.

Also, it needs sealing members for sealing open ends formed when machining a communication path in part of the back pressure passage, and therefore the number of required components increases. Furthermore, even if a dent is formed in the end-plate of the fixed scroll, machining will become complex and the area between the sliding faces of the two scroll end-plates decreases, and there is fear that the sealing performance between the back pressure chamber and the compression chamber is adversely affected.

An object of the present invention is to solve the problems of the above conventional art, to enhance the compression efficiency by reducing the flow resistance of fluid flowing in and out between the back pressure chamber and the compression chamber, and to enhance reliability by simplifying the fabrication of the orbiting scroll and by reducing the number of required components. Another object is to secure a sufficient area between the sliding faces of the two scroll end-plates and to thereby improve the sealing performance between the back pressure chamber and the compression chamber.

In order to attain the above objects, the invention provides a scroll fluid machine comprising an orbiting scroll and a fixed scroll equipped with wraps erected on end-plates, compression chambers defined with the orbiting scroll orbiting in a state of being inhibited from self-turning relative to the fixed scroll, and a back pressure chamber formed on the face of the orbiting scroll opposite from the wrap. The machine has a back pressure port formed in the end-plate of the orbiting scroll and connecting from a compression chamber side opening opened on a compression chamber side to a back pressure chamber side opening opened on a back pressure chamber side, wherein the compression chamber side opening is opened and closed by the end-plate of the fixed scroll according as orbiting motion of the orbiting scroll and connection and blockage of the back pressure port is performed.

According to the invention, the back pressure port connecting from the compression chamber to the back pressure chamber is opened and closed at the compression chamber side opening by the end-plate of the fixed scroll with the orbiting motion of the orbiting scroll, and it is possible to make the flow resistance small, enhance the compression efficiency, and increase the reliability of the scroll fluid machine. Further, by securing a sufficient area between the sliding faces of the two scroll end-plates, the sealing performance between the back pressure chamber and the compression chamber can be improved and the output of the machine can be increased.

Other objects, features and advantages of the invention will become apparent from the following description of the embodiments of the invention taken in conjunction with the accompanying drawings.

DETAILED DESCRIPTION OF THE INVENTION

Figure 5:
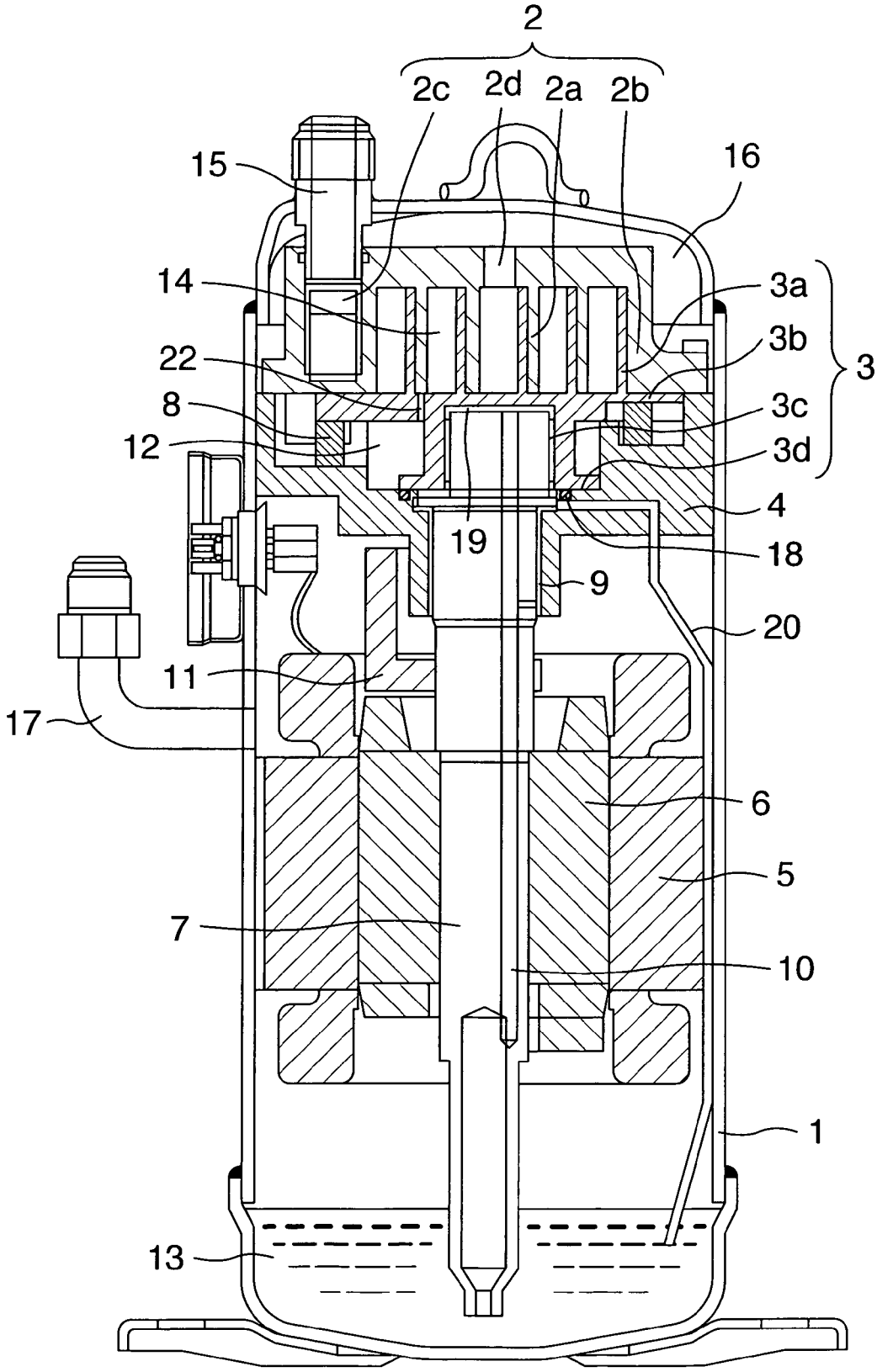
FIG. 5 is a side sectional view of the embodiment of the invention.

A scroll compressor used as a scroll fluid machine will be described with reference to FIG. 5. The scroll compressor has a construction in which a compression unit, a drive unit and an oil supply path are accommodated in a hermetic shell 1.

The basic elements of the compression unit are a fixed scroll 2, an orbiting scroll 3 and a frame 4. The basic component parts of the fixed scroll 2 are a wrap 2*a*, an end-plate 2*b*, a suction port 2*c* and a discharge port 2*d*, and those of the orbiting scroll 3 are a wrap 3*a*, an end-plate 3*b*, a bearing 3*c* and a bearing end face 3*d*. The frame 4 is fixed to the hermetic shell 1 by welding or the like, and the fixed scroll 2 is secured to the frame 4 with bolts, etc.

The basic elements of the drive unit which drives the orbiting scroll 3 for orbital motion are a stator 5 and a rotor 6 where an induction motor is used as an example of rotation drive device, a crankshaft 7, an Oldham-coupling ring 8 which is the main component of a self-turning preventive mechanism for the orbiting scroll 3, the main bearing 9 of the crankshaft which rotatably engages the frame 4 and the crankshaft 7, and the bearing 3*c* of the orbiting scroll which engages the orbiting scroll 3 and an eccentric part of the crankshaft 7 movably in the direction of the crankshaft and rotatably.

The main bearing 9 is built in the frame 4. The stator 5 is fixed to the hermetic shell 1 by shrinkage fitting or the like. The rotor 6 is arranged rotatably in the annular-shaped stator 5. The crankshaft 7 is rotatably supported by the main bearing 9. An intermediate part of the crankshaft 7 penetrates the central part of the rotor 6. An oil supply hole 10 is bored in the crankshaft 7 to open in opposite end faces of the axial part of the crankshaft 7, and a balancing weight 11 is engaged with the crankshaft, which is a balancing component for canceling the unbalancing force caused from the motion of the orbiting scroll 3 and for restraining vibration of the compressor.

The Oldham-coupling ring 8, together with the orbiting scroll 3, is disposed within the back pressure chamber 12 defined by the frame 4 and the fixed scroll 2, and one of two pairs of mutually orthogonal key portions formed on the Oldham-coupling ring 8 is adapted to slide in a key groove formed in the frame 4 and the other slides in another key groove formed in the rear side of the orbiting scroll end-plate 3*b*.

Lubricating oil 13 stored in a space in the lower part of the hermetic shell 1 is supplied to the compression unit and to the bearings 3*c* and 9 through the oil supply hole 10 formed in the axial part of the crankshaft 7 by means of a centrifugal pumping action of the eccentric rotary operation of the oil supply ports 10, etc.

When the orbiting drive device is the induction motor, the rotor 6 is given turning force by a rotating magnetic field generated by the stator 5, and the crankshaft 7 secured to the rotor 6 turns according as rotation of the rotor 6. The orbiting scroll 3 is engaged with the eccentric part of the crankshaft 7 to be movable in the direction of the rotation axis and to be rotatable, and the rotational motion of the crankshaft 7 is converted into the orbiting motion of the orbiting scroll 3 by the self-turning preventive mechanism, such as the Oldham-coupling ring 8. The volume of the compression chambers 14, which are closed spaces defined by engaging the fixed scroll 2 and the orbiting scroll 3 with each other, is reduced according as the orbiting scroll 3 makes the orbiting motion. In the compressing action, according as the orbiting motion of the orbiting scroll 3, working fluid is sucked into the compression chamber 14 via a suction pipe 15 and the suction port 2*c*. The sucked working fluid is connected to the discharge port 2*d* through the compression process in the compression chambers 14, and is discharged via a discharge chamber 16 and a discharge pipe 17. Incidentally, when the fixed scroll 2 and the orbiting scroll 3 are engaged with each other to perform the compression, it is essential to secure sufficient airtightness so as to minimize working fluid leakage from the compression chambers 14.

The embodiment will be now described in detail with reference to FIG. 1 through FIG. 3.

Figure 1:
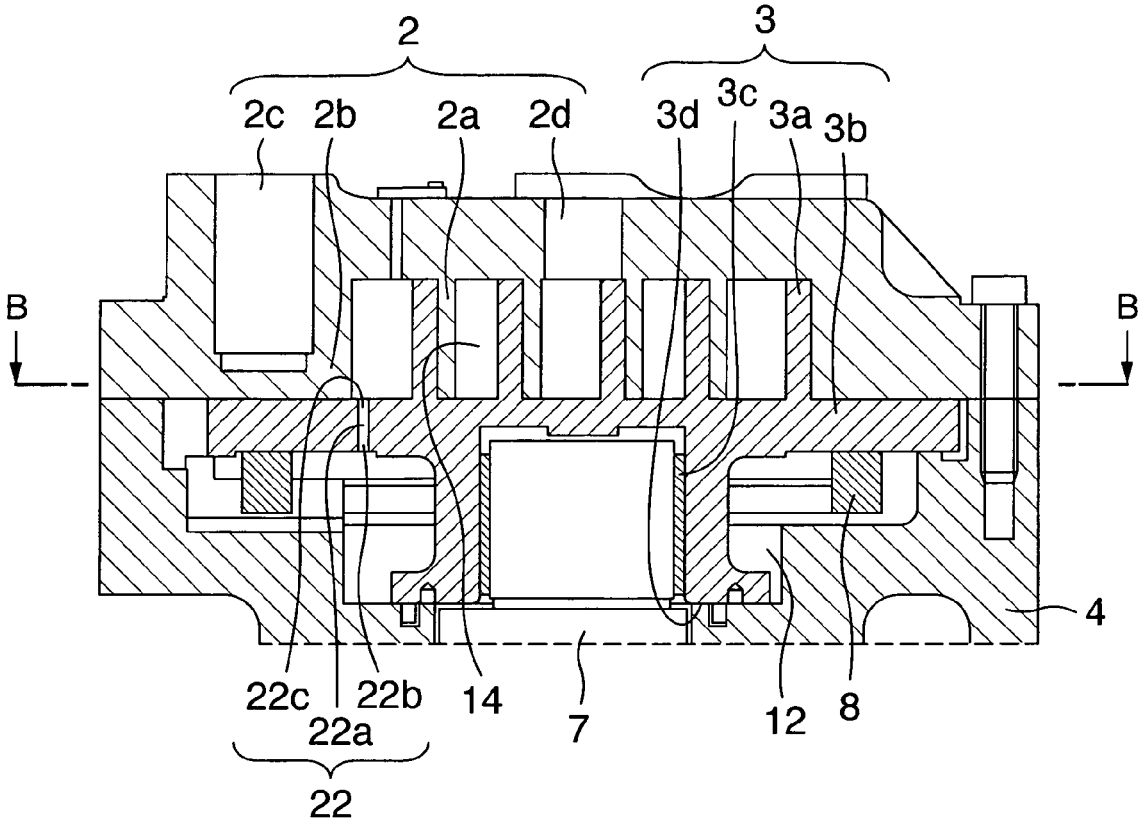
FIG. 1 is a partial side sectional view of an embodiment of the present invention.

FIG. 1 shows the scroll compressor, in particular the side view of its back pressure port part communicating from the compression chamber to the back pressure chamber. The space formed behind the orbiting scroll end-plate 3*b* on which the Oldham-coupling ring 8 slides is the back pressure chamber 12, and the hermetic spaces defined by engaging the fixed scroll 2 and the orbiting scroll 3 with each other are the compression chambers 14. The back pressure port 22 is formed in the orbiting scroll end-plate 3*b*, and has a back pressure chamber side opening 22*b*, which opens in the back pressure chamber 12, and a communication path 22*a* of the back pressure port 22 kept in communication with the back pressure chamber 12 all the time.

Figure 2:
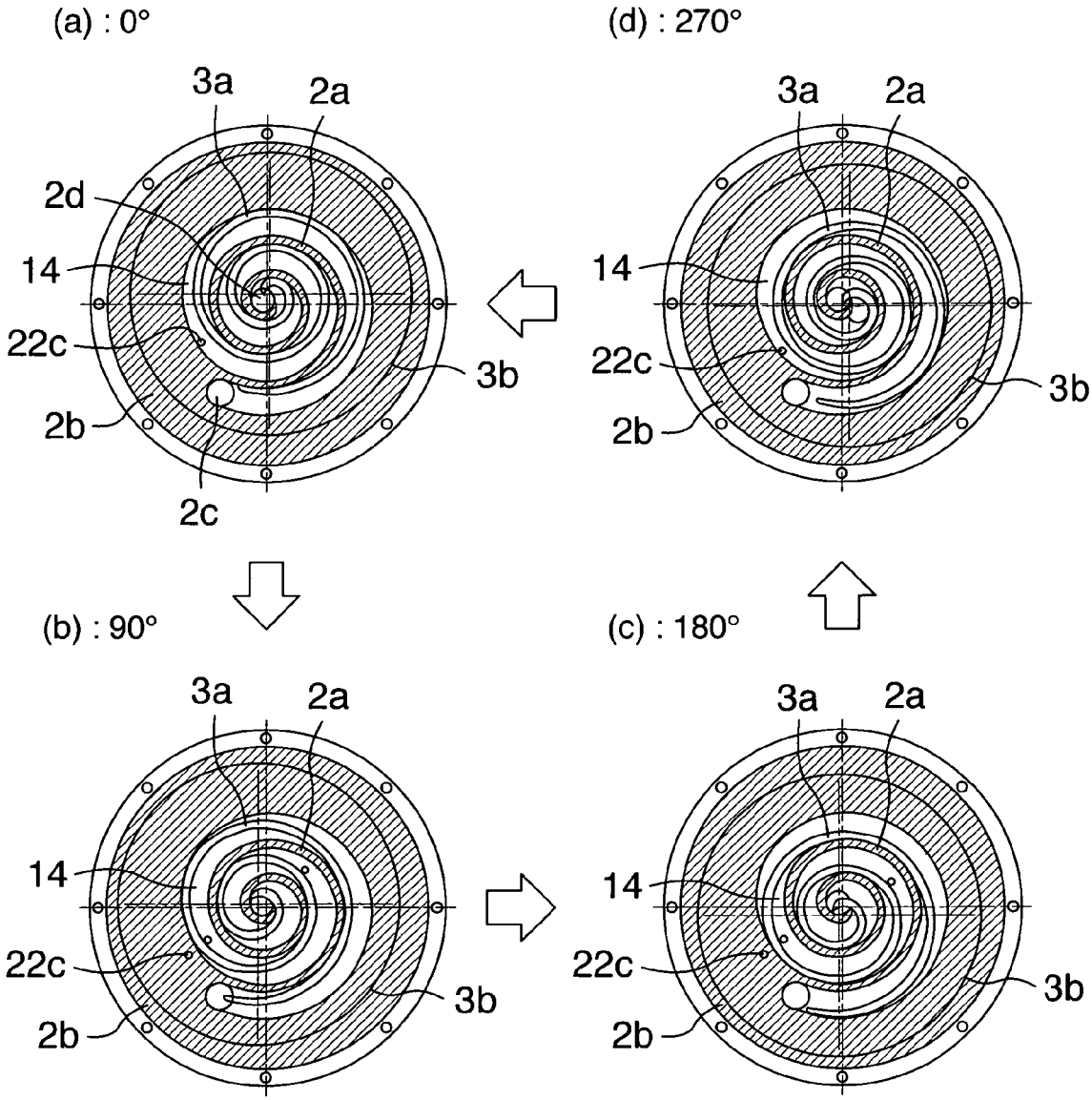
FIG. 2 is plan views illustrating the operation of the embodiment of the invention.
Figure 3:
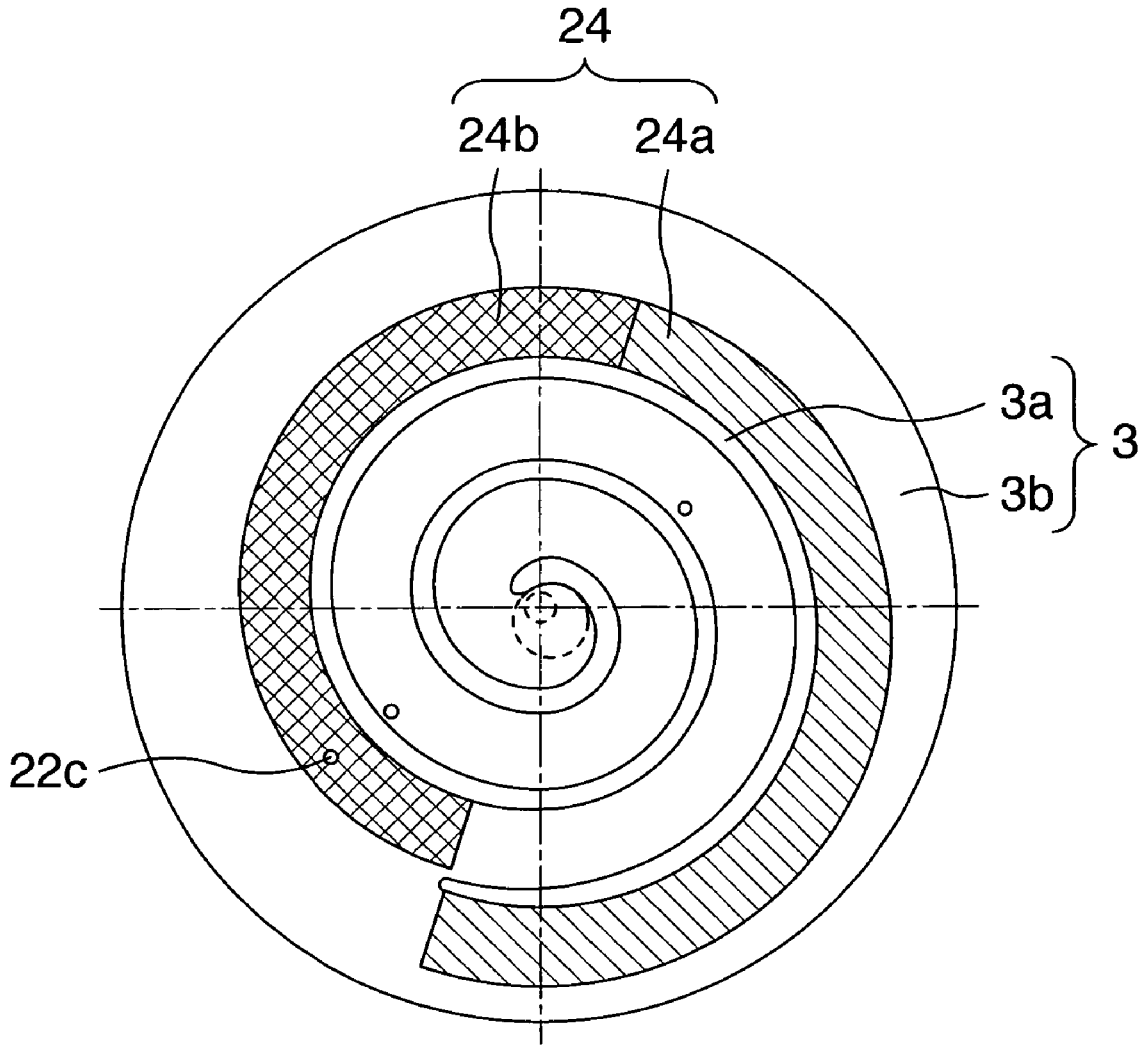
FIG. 3 is a plan view showing the range of installation of a back pressure port in the embodiment of the invention.

FIG. 2 shows the B-B section in FIG. 1 and the functions and effect of the back pressure port 22 during the compressive process will be described.

The back pressure port 22 is represented by the compression chamber side opening 22*c* of the back pressure port, which is opened to the compression chamber 14. FIG. 2 shows respective meshing states (b)-(d) of the scrolls in orbiting positions of the orbiting scroll 3 at every 90° interval from a starting point (a) where the compression chamber 14 defined on the inner line side of the wrap of the orbiting scroll 3 has finished suction.

According as the orbiting motion of the orbiting scroll 3, the working fluid is sucked into the compression chambers 14 through the suction port 2*c* of the fixed scroll. The working fluid sucked is gradually reduced in its volume, namely compressed, in the compression chambers 14 according to the orbiting motion of the orbiting scroll 3, and is discharged when the compression chambers 14 reach a position of communication with the fixed scroll discharge port 2*d*.

The compression chamber side opening 22*c* of the back pressure port, in the meshing state (a) of FIG. 2 where the compression chamber 14 defined on the inner line side of the wrap of the orbiting scroll 3 has completed suction, is open to the compression chamber 14, not blocked by the end-plate 2*b* of the fixed scroll. Thus, the back pressure chamber 12 and the compression chamber 14 communicate with each other via the back pressure port 22.

According as the compression operation progresses, in the middle of reaching the state (b) of FIG. 2, the compression chamber side opening 22*c* of the back pressure port begins to be blocked by the end-plate 2*b* of the fixed scroll while providing incomplete communication between the back pressure chamber 12 and the compression chamber 14 and is gradually blocked.

In the process from (b) to (c) of FIG. 2, the compression chamber side opening 22*c* of the back pressure port is blocked by the end-plate 2*b* of the fixed scroll, and the back pressure chamber 12 and the compression chamber 14 are blocked from each other.

When the state (d) of FIG. 2 is reached, as the compression chamber side opening 22*c* of the back pressure port is moved away from the end-plate 2*b* of the fixed scroll and begins to open to the compression chamber 14, the back pressure chamber 12 and the compression chamber 14 communicate with each other again.

As described above, the compression chamber side opening 22*c* of the back pressure port 22 which opens to the compression chamber 14 is intermittently opened and closed by the end-plate 2*b* of the fixed scroll according as the orbiting of the orbiting scroll 3.

Therefore, the duration of communication can be made short as compared with a back pressure port which keeps the back pressure chamber 12 and the compression chamber 14 communicating with each other all the time, and energy (power) loss of the fluid flowing in and out of the back pressure port 22 can thereby be reduced.

The constant communication of the back pressure chamber side opening 22*b* and the communication path 22 of the back pressure port 22 with the back pressure chamber 12 enables intermittent opening and closing of the compression chamber side opening 22*c* to provide a necessary and sufficient flow rate of the fluid moving between the back pressure chamber 12 and the compression chamber 14 in short intermittent lengths of time with little flow resistance and without obstructing the compressive action.

Also, by adjusting the positioning, opening shape or the moving distance of the orbiting motion of the compression chamber side opening 22*c* of the back pressure port, the pressure of the back pressure chamber 12 can be controlled, working fluid leakage from the compression chambers 14 can be prevented, and pressing force for securing sufficient airtightness in a broad range of rotational speed can be obtained.

Further, because the back pressure port 22 is intermittently opened and closed by the end-plate of the fixed scroll, not at the opening 22*b* opened to the back pressure chamber 12, but at the opening 22*c* opened to the compression chamber 14, the back pressure port 22 can be formed in a simpler shape, for instance a shape with fewer bends. It is made unnecessary to form a dent in the fixed scroll end-plate 2*b*, and this allows securing a sufficient area between the sliding faces of the two scroll end-plates and thereby improving the sealing performance between the back pressure chamber and the compression chamber.

Furthermore, not only can the fabrication of the back pressure port 22 and the fixed scroll end-plate 2*b* be simplified but also can the number of component parts required for the back pressure port 22 be reduced.

Further, when the back pressure port 22 is shaped to penetrate the orbiting scroll end-plate 3*b* by means of a straight hole so as to make the back pressure chamber 12 and the compression chamber 14 communicate with each other in the shortest distance, the flow resistance of the back pressure port 22 can be made even smaller and its machining further simplified.

It is preferable for the compression chamber side opening 22*c* of the back pressure port shown in FIG. 2 to open to the compression chamber 14 in the compression stroke after the sucking of the working fluid is completed. More specifically, when the compression chamber side opening 22*c* of the back pressure port is opened in a position of communication with the fixed scroll suction port 2*c*, the lubricating oil 13 which has larger density and higher temperature than the sucked working fluid is fed to the suction port 2*c* via the back pressure port 22, heats and expands the working fluid to reduce the sucked volume. Therefore, the compression chamber side opening 22*c* of the back pressure port can be made more effective by forming it to open to the compression chamber 14 in the compression stroke after the completion of suction of the working fluid.

In connection with FIG. 2, the description has been made with reference to the scroll wrap in which the outer line side compression chambers formed on the outer line side of the wrap of the orbiting scroll 3 and the inner line side compression chambers formed on the inner line side of the wrap differ in suction volume (hereinafter referred to as an asymmetric scroll wrap). However, similar function and effect can be obtained with a scroll wrap in which outer line side compression chambers and inner line side compression chambers are equal in suction volume (hereinafter referred to as a symmetric scroll wrap).

The suitable position for installation of the compression chamber side opening of the back pressure port will now be described in detail with reference to FIG. 3. A range 24 combined a shaded part 24*a* and a cross-shaded part 24*b* on the orbiting scroll end-plate 3*b* in FIG. 3 is defined on the outermost circumferential part of an orbiting scroll wrap 3*a* in the case where the asymmetric scroll wrap is used for the fixed scroll 2 and the orbiting scroll 3, and is defied for the distance of orbiting motion from the outer line of the orbiting scroll wrap 3*a* toward the outer circumference. This range 24 is the plane in which the wraps slides on the fixed scroll end-plate 2*b* according as the orbiting motion of the orbiting scroll 3, and is also the plane where the compression chambers 14 are defined according to the orbiting position of the orbiting scroll 3.

Therefore, by locating in the range 24 the compression chamber side opening 22*c* which is to be opened to the compression chamber 14 of the back pressure port 22, the compression chamber side opening 22*c* is intermittently opened and closed by the fixed scroll end-plate 2*b* according as the orbiting motion of the orbiting scroll 3. It is accordingly preferable to arrange the compression chamber side opening 22*c* of the back pressure port 22 in the range 24.

When the symmetric scroll wrap is used for the fixed scroll 2 and the orbiting scroll 3, only the cross-shaded part 24*b* is the suitable range for arranging the compression chamber side opening 22*c* of the back pressure port.

In the asymmetric scroll wrap, the inner line of the wrap 2*a* of the fixed scroll for completing suction of the working fluid and for starting the compression stroke is extended farther toward the suction port 2*c* than in the symmetric scroll wrap. As a result, when an asymmetric scroll wrap is used, the shaded part 24*a* is the plane for slide with the fixed scroll end-plate 2*b* resulted from the orbiting motion of the orbiting scroll 3, is also the plane where the compression chambers 14 are formed according as the orbiting position of the orbiting scroll 3, and provides the suitable range for arranging the compression chamber side opening 22*c* of the back pressure port. Use of the asymmetric scroll wrap allows increasing the range for arranging the compression chamber side opening 22*c* of the back pressure port as compared with the symmetric scroll wrap.

Although the invention is applicable to the scroll fluid machine of a construction in which most part of the lubricating oil having lubricated the respective bearings infiltrates into the compression chambers 14, its application to the scroll fluid machine of a construction in which sealing members are provided on the lower end face of the orbiting scroll 3 and within the frame 4 facing that lower end face and an oil return device which causes the lubrication oil to lubricate the respective bearings without infiltration of most part of the lubrication oil into the compression chambers 14 is provided can reduce more the flow rate of the lubrication oil flowing through the back pressure port 22 in and out of the compression chamber 14.

Figure 4:
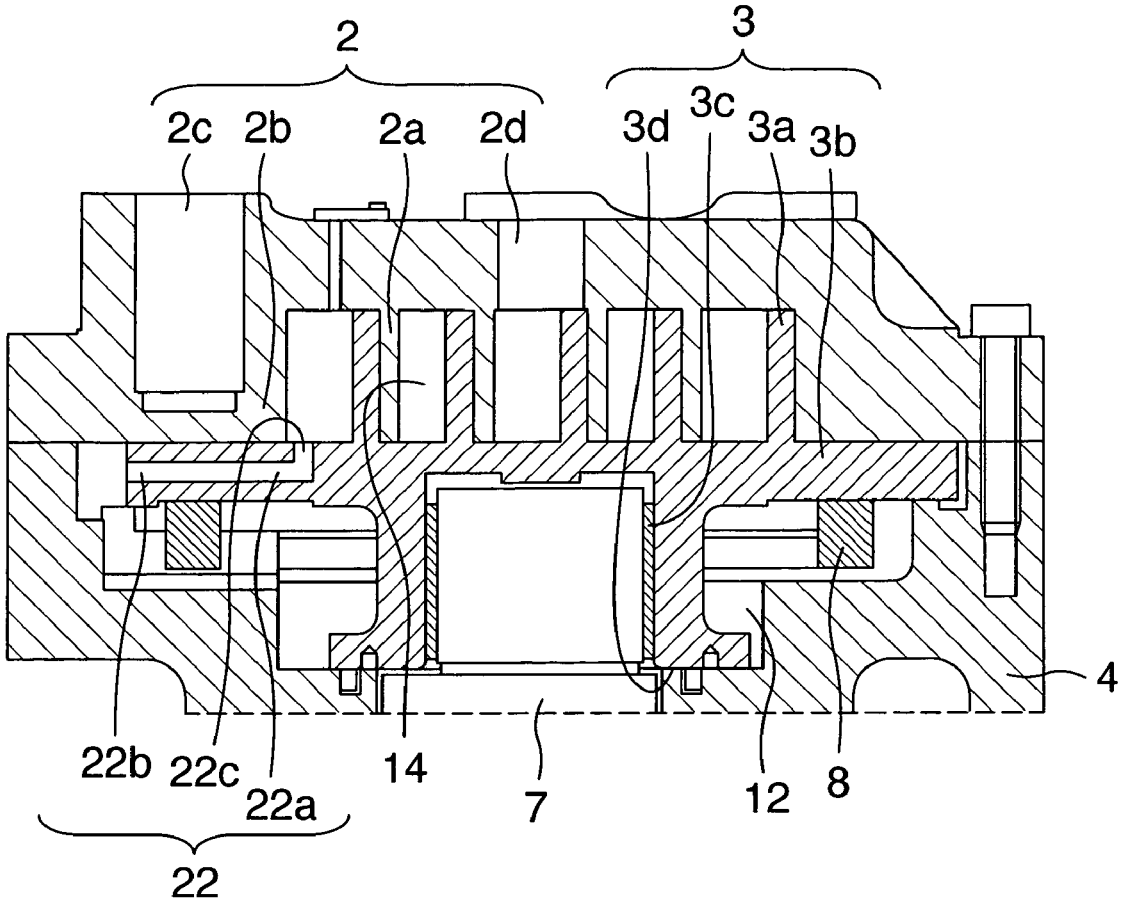
FIG. 4 is a partial side sectional view of another embodiment of the invention.

Another preferred embodiment of the invention will be described in detail with reference to FIG. 4. FIG. 4 is a profile of a scroll compressor around its back pressure port.

The opening 22*b* of the back pressure port 22, which opens to the back pressure chamber 12, is in the outer peripheral side face of the orbiting scroll end-plate 3*b*. In the space surrounded by the outer peripheral side end face of the orbiting scroll end-plate 3*b* and the frame 4, the lubricating oil 13 which lubricates the compression chamber s 14 and the sliding faces of the both scroll end-plates tends to accumulate. Accumulation of the lubrication oil 13 having larger density than the working fluid such as refrigerant would increase the loss because, when the orbiting scroll 3 makes the orbiting motion, the outer peripheral side end face of the orbiting scroll end-plate 3*b* draws in or stirs the lubricating oil 13.

However, since the opening 22*b* is provided in the outer peripheral side face of the orbiting scroll end-plate 3*b*, the lubrication oil 13 in the space surrounded by the outer peripheral side end face of the orbiting scroll end-plate 3*b* and the frame 4 can be forcibly fed according as the orbiting motion of the orbiting scroll 3 to the compression chamber side opening 22*c* and to the compression chambers 14 from the back pressure chamber side opening 22*b* of the back pressure port 22 through the communication path 22*a*, and the loss due to the drawing or stirring of the lubrication oil 13 can be thereby reduced.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll fluid machine comprising an orbiting scroll and a fixed scroll equipped with wraps erected on end-plates, compression chambers defined with the orbiting scroll orbiting in a state of being inhibited from self-turning relative to the fixed scroll, and a back pressure chamber formed on a face of the orbiting scroll opposite from the wrap, the machine further having a back pressure port formed in an end-plate of the orbiting scroll and connecting from a compression chamber side opening opened on a compression chamber side to a back pressure chamber side opening opened on a back pressure chamber side, wherein the compression chamber side opening is opened and closed by the end-plate of the fixed scroll as connection and blockage of the back pressure port is performed according to orbiting motion of the orbiting scroll;

wherein at a starting position of the orbiting scroll of 0° the compression chamber defined on an inner line side of the wrap of the orbiting scroll has finished suction;

wherein when the orbiting scroll is between 270° position and 0° position the compression chamber side opening is opened to the compression chamber so that the compression chamber and the back pressure chamber can communicate with each other;

when the orbiting scroll is between 90° position and 180° position the compression chamber side opening is closed to the compression chamber so that the compression chamber and the back pressure chamber are blocked from each other.

2. A scroll fluid machine according to claim 1, wherein the outer line side compression chambers formed on an outer line side of the orbiting scroll wrap and the inner line side compression chambers formed on the inner line side of the orbiting scroll wrap differ in suction volume.

3. A scroll fluid machine according to claim 2, wherein said back pressure chamber side opening is provided on the face of the orbiting scroll opposite from the wrap.

4. A scroll fluid machine according to claim 2, wherein said back pressure port is connected from a face of the orbiting scroll where the wrap is erected to the opposite face thereof.

5. A scroll fluid machine according to claim 2, wherein said back pressure port is formed in a straight hole penetrating the orbiting scroll from a face thereof where the wrap is erected to the opposite face.

6. A scroll fluid machine according to claim 2, wherein said compression chamber side opening is positioned in a range defined from an outermost peripheral part of the orbiting scroll wrap and for a distance of orbiting motion toward an outer peripheral side.

7. A scroll fluid machine according to claim 2, wherein said back pressure chamber side opening is provided in an outer peripheral side face of the end-plate of the orbiting scroll.

* * * * *